US010415361B1

(12) United States Patent
Zahran

(10) Patent No.: US 10,415,361 B1
(45) Date of Patent: Sep. 17, 2019

(54) SEPARATING GAS AND LIQUID IN A WELLBORE

(71) Applicant: Saudi Arabian Oil Company, Dhahran (SA)

(72) Inventor: Amr Mohamed Zahran, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 15/927,236

(22) Filed: Mar. 21, 2018

(51) Int. Cl.
*E21B 33/12* (2006.01)
*E21B 43/12* (2006.01)
*E21B 43/38* (2006.01)

(52) U.S. Cl.
CPC ..... *E21B 43/38* (2013.01); *E21B 33/12* (2013.01); *E21B 43/121* (2013.01)

(58) Field of Classification Search
CPC ..... E21B 33/12; E21B 43/121; E21B 43/38
See application file for complete search history.

(56) References Cited

U.S. PATENT DOCUMENTS 5,211,242 A 5/1993 Coleman et al.
5,431,228 A * 7/1995 Weingarten ..... B01D 17/00 166/169
6,089,322 A 7/2000 Kelley et al.
6,138,758 A 10/2000 Shaw et al.
6,367,547 B1 4/2002 Towers et al.
6,481,499 B2 * 11/2002 Lopes ..... E21B 43/38 166/105.5
6,932,160 B2 * 8/2005 Murray ..... E21B 43/38 166/105.5
8,136,600 B2 * 3/2012 Fowler ..... B01D 19/0057 166/267
8,322,434 B2 * 12/2012 Fielding ..... E21B 43/38 166/105.5

(Continued)

OTHER PUBLICATIONS

McCoy et al., "Downhole Gas Separators: A Laboratory and Field Study," presented at the Gas Well De-Liquification Workshop, Feb. 27-Mar. 1, 2006, 47 pages.

(Continued)

*Primary Examiner* — Matthew R Buck
(74) *Attorney, Agent, or Firm* — Fish & Richardson P.C.

(57) ABSTRACT

A downhole fluid separator includes a first tubular including a volume defined between an open, uphole end of the first tubular opposite an open, downhole end of the first tubular, the volume of the first tubular including a fluid pathway configured to receive a mixed-phase fluid from an annulus of a wellbore and provide separate flows of a gas and a liquid to the uphole end of the first tubular; a second tubular including a volume configured to receive at least a portion of a downhole artificial lift device through an open, uphole end of the second tubular opposite a closed, downhole end of the second tubular, and an adjustable opening formed in a portion of the second tubular at a location between the uphole and downhole ends and configured to selectively receive the flow of the liquid into the volume of the second tubular; and an actuatable wellbore seal positioned around each of the first and second tubulars and between the first and second tubulars, downhole of the adjustable opening, and between the uphole ends and the downhole ends of the respective first and second tubulars.

22 Claims, 5 Drawing Sheets

(56) References Cited

U.S. PATENT DOCUMENTS

| | | | | |
|---|---|---|---|---|
| 9,518,458 | B2 * | 12/2016 | Ellithorp | E21B 43/127 |
| 9,670,758 | B2 * | 6/2017 | Wilson | E21B 43/128 |
| 9,765,608 | B2 * | 9/2017 | Sims | E21B 43/121 |
| 2004/0238179 | A1 | 12/2004 | Murray | |
| 2016/0130922 | A1 | 5/2016 | Wilson | |
| 2016/0333681 | A1 | 11/2016 | Mazzanti | |

OTHER PUBLICATIONS

McCoy and Podio, "Improved Downhole Gas Separators," presented at the Southwestern Petroleum Short Course, Apr. 7-8, 1998, 11 pages.

Samayamantula, "An Innovative Design for Downhole Gas Separation," Don-Nan Pump and Supply Company, presented at the Oil and Gas Technology Webinar hosted by IEEE, Engineering 360, May 22, 2013, 16 pages.

International Search Report and Written Opinion issued in International Application No. PCT/US2019/022850 dated Jun. 26, 2019, 15 pages.

* cited by examiner

SEPARATING GAS AND LIQUID IN A WELLBORE

TECHNICAL FIELD

This disclosure relates to separating gas and liquid in a wellbore.

BACKGROUND

Artificial lift devices (for example, pumps) are often required to increase or sustain producing oil wells and liquid rich gas wells in order to lower a bottomhole flowing pressure to a desired draw down level and pump up the fluids to the surface to maximize an ultimate hydrocarbon recovery. In some cases, a presence of free gas may affect a pump operation and lower a pump efficiency. This may lead to more frequent work over for pump replacements, which increases an operating cost and affects a reservoir productivity due to, for example, killing fluid sensitivity.

SUMMARY

In a general implementation, a downhole fluid separator includes a first tubular including a volume defined between an open, uphole end of the first tubular opposite an open, downhole end of the first tubular, the volume of the first tubular including a fluid pathway configured to receive a mixed-phase fluid from an annulus of a wellbore and provide separate flows of a gas and a liquid to the uphole end of the first tubular; a second tubular including a volume configured to receive at least a portion of a downhole artificial lift device through an open, uphole end of the second tubular opposite a closed, downhole end of the second tubular, and an adjustable opening formed in a portion of the second tubular at a location between the uphole and downhole ends and configured to selectively receive the flow of the liquid into the volume of the second tubular; and an actuatable wellbore seal positioned around each of the first and second tubulars and between the first and second tubulars, downhole of the adjustable opening, and between the uphole ends and the downhole ends of the respective first and second tubulars.

In an aspect combinable with the general implementation, the second tubular has a length greater than a length of the first tubular.

In another aspect combinable with any one of the previous aspects, the first tubular further includes a plurality of baffles configured to separate the mixed-phase fluid into the separate flows of the gas and the liquid.

In another aspect combinable with any one of the previous aspects, the actuatable wellbore seal includes one or more packers configured to, when actuated, fluidly seal a portion of the annulus adjacent the respective downhole ends of the first and second tubulars from another portion of the annulus adjacent the respective uphole ends of the first and second tubulars.

In another aspect combinable with any one of the previous aspects, the one or more packers include production packers.

In another aspect combinable with any one of the previous aspects, the one or more packers include a first packer positioned around the first tubular and a second packer positioned around the second tubular.

In another aspect combinable with any one of the previous aspects, the adjustable opening includes a sliding side door formed in the portion of the second tubular, the sliding side door configured to selectively open in response to an intervention operation.

Another aspect combinable with any one of the previous aspects further includes a particulate trap positioned in the closed, downhole end of the second tubular and configured to trap particulates entrained in the liquid.

In another aspect combinable with any one of the previous aspects, the downhole artificial lift device includes a progressive cavity pump or a sucker rod pump.

Another aspect combinable with any one of the previous aspects further includes a particulate screen positioned in the open, downhole end of the first tubular and configured to screen particulates from the mixed-phase fluid.

In another aspect combinable with any one of the previous aspects, the mixed-phase fluid includes at least one of a hydrocarbon liquid or a hydrocarbon gas.

In another general implementation, a method for separating a mixed-phase fluid include running a downhole tool into a wellbore. The downhole tool includes a first tubular including a volume defined between an open, uphole end of the first tubular opposite an open, downhole end of the first tubular, a second tubular including a volume that includes at least a portion of a downhole artificial lift device and is defined between an open, uphole end of the second tubular opposite a closed, downhole end of the second tubular, and a wellbore seal radially positioned around each of the first and second tubulars and between the first and second tubulars, and axially positioned between the uphole ends and the downhole ends of the respective first and second tubulars. The method further includes receiving a flow of a mixed-phase fluid into the open, downhole end of the first tubular; separating, in the volume of the first tubular, the mixed-phase fluid into a flow of a gas and a flow of a liquid; directing the flows of the gas and the liquid out of the open, uphole end of the first tubular; selectively receiving the flow of the liquid into the volume of the second tubular through an adjustable opening positioned in the second tubular; and removing, with the downhole artificial lift device, the flow of the liquid from the volume of the second tubular into a production tubing.

In an aspect combinable with the general implementation, the second tubular has a length greater than a length of the first tubular.

In another aspect combinable with any one of the previous aspects, separating the mixed-phase fluid into the flow of the gas and the flow of the liquid includes directing the mixed-phase fluid through a plurality of baffles positioned in the volume of the first tubular; and separating, with the plurality of baffles, the mixed-phase fluid into the flows of the gas and the liquid.

Another aspect combinable with any one of the previous aspects further includes, prior to receiving the flow of the mixed-phase fluid into the open, downhole end of the first tubular, actuating the wellbore seal to fluidly seal a portion of an annulus of the wellbore adjacent the respective downhole ends of the first and second tubulars from another portion of the annulus adjacent the respective uphole ends of the first and second tubulars.

In another aspect combinable with any one of the previous aspects, the wellbore seal includes a first packer positioned around the first tubular and a second packer positioned around the second tubular.

In another aspect combinable with any one of the previous aspects, the adjustable opening includes a sliding side door formed in the portion of the second tubular, the method further including performing an intervention operation to open the sliding side door.

Another aspect combinable with any one of the previous aspects further includes filtering particulates entrained in the liquid with a particulate trap positioned in the closed, downhole end of the second tubular In another aspect combinable with any one of the previous aspects, the downhole artificial lift device includes a progressive cavity pump or a sucker rod pump.

Another aspect combinable with any one of the previous aspects further includes filtering particulates from the mixed-phase fluid with a particulate filter positioned in the open, downhole end of the first tubular.

Another aspect combinable with any one of the previous aspects further includes receiving the flow of the liquid through the production tubing and at a terranean surface; and receiving the flow of the gas from the open, uphole end of the first tubular, into and through the wellbore, and at the terranean surface.

In another aspect combinable with any one of the previous aspects, the mixed-phase fluid includes at least one of a hydrocarbon liquid or a hydrocarbon gas.

Implementations of a downhole fluid separation tool according to the present disclosure may include one or more of the following features. For example, implementations of the downhole fluid separation tool may have no length (within a wellbore) limitation unlike conventional downhole hydrocarbon separators. As another example, the downhole fluid separation tool may be used with a variety of artificial lift systems, including rod driving artificial lift systems. As a further example, the downhole fluid separation tool may be re-used in multiple, different wellbores. Also, the downhole fluid separation tool may have few or no moving parts, thereby increasing reliability and cost effectiveness. As a further example, the downhole fluid separation tool may help reduce or eliminate downhole pump gas locking due to a presence of downhole free gas at an intake, which may result in less frequent pump failures that require expensive workover operations to repair or replace downhole equipment. Also, the downhole fluid separation tool may divert a flow path at the artificial lift device intake to allow proper gas separation in order to deliver only, or substantially only, liquid into the intake to avoid free gas being delivered to the intake.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

The present disclosure describes a downhole fluid separation tool that is operable to separately produce a gas phase of a mixed-phase fluid and a liquid phase of the mixed-phase fluid from a subterranean zone to a terranean surface. In some aspects, one or both of the gas phase or the liquid phase includes a hydrocarbon fluid. The tool, in some aspects, includes tubular conduits affixed to each other and positioned in a wellbore with one or more wellbore seals. At least one of the tubular conduits receives the mixed-phase fluid and separates the fluid into the gas and liquid phases. At least another of the tubular conduits receives the liquid phase and produces, with an artificial lift device positioned within the tubular, the liquid phase to the terranean surface.

Figure 1:
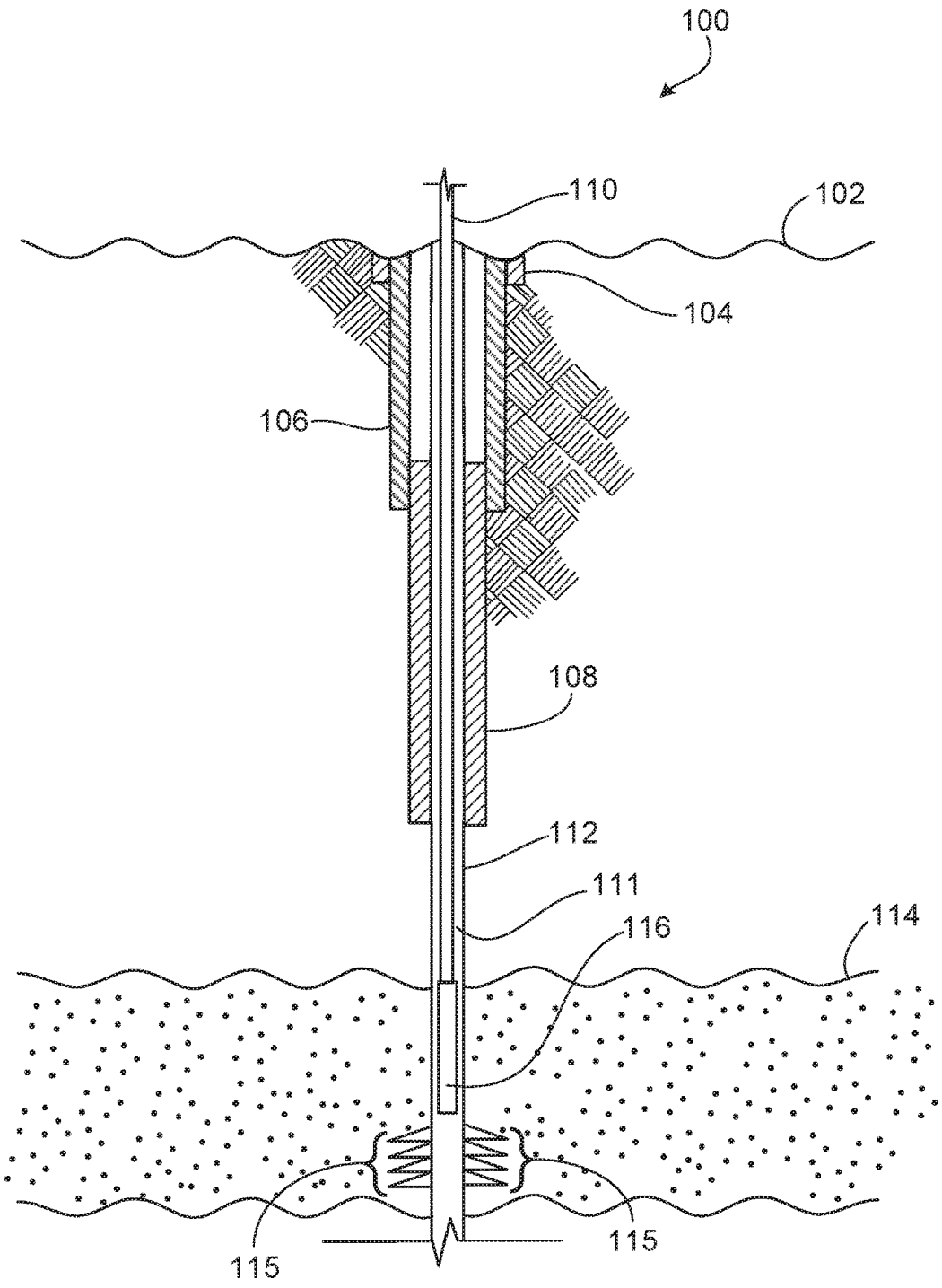
FIG. 1 is a schematic illustration of a wellbore system that includes an example implementation of a downhole fluid separation tool.

FIG. 1 is a schematic illustration of a wellbore system 100 that includes an example implementation of a downhole fluid separation tool 116. Generally, FIG. 1 illustrates a portion of one embodiment of a wellbore system 100 according to the present disclosure in which a downhole fluid separation tool, such as the downhole fluid separation tool 116, may receive a flow of a mixed-phase fluid from a rock formation of a subterranean zone 114 and separate the mixed-phase fluid into a flow of a liquid phase and a flow of a gas phase to be produced to a terranean surface 102. In some aspects, the mixed-phase fluid may comprise one or more hydrocarbon gas phases (for example, methane or other fractional gas) and one or more hydrocarbon liquid phases (for example, oil or otherwise). In some aspects, the mixed-phase fluid may also or alternatively comprise liquid water, such as brine, freshwater, or otherwise.

The downhole fluid separation tool 116, in some aspects, may direct the flow of the mixed-phase fluid (for example, gas and oil, gas and oil and water, gas and water, or otherwise) into a single fluid pathway of a separation tubular of the tool 116. One or more separation devices, such as baffles or otherwise, may separate the mixed-phase fluid into a liquid phase and a gas phase. While the gas phase may flow through the separation tubular into an annulus of a wellbore 112 (that may be cased, partially cased, or open hole), while the liquid phase may be directed into a production tubular of the downhole fluid separation tool 116. The liquid phase may be mechanically removed to the terranean surface, such as by one or more artificial lift systems (for example, sucker rod pump, progressive cavity pump, or otherwise), through a production casing.

As illustrated in FIG. 1, an implementation of the wellbore system 100 includes a downhole conveyance 110 that is operable to convey (for example, run in, or pull out or both) the downhole fluid separation tool 116 into the wellbore 112. Although not shown, a drilling assembly deployed on the terranean surface 102 may form the wellbore 112 prior to running the downhole fluid separation tool 116 into the wellbore 112 to a particular location in the subterranean zone 114. The drilling assembly forms the wellbore 112 extending from the terranean surface 102 and through one or more geological formations in the Earth. One or more subterranean formations, such as subterranean zone 114, are located under the terranean surface 102. As will be explained in more detail below, one or more wellbore casings, such as a surface casing 106 and intermediate casing 108, may be installed in at least a portion of the wellbore 112.

In some embodiments, the wellbore system 100 may be deployed on a body of water rather than the terranean surface 102. For instance, in some embodiments, the terranean surface 102 may be an ocean, gulf, sea, or any other body of water under which hydrocarbon-bearing formations may be found. In short, reference to the terranean surface 102 includes both land and water surfaces and contemplates forming and developing one or more wellbore systems 100 from either or both locations.

In some aspects, the downhole conveyance 110 may be a tubular production string made up of multiple tubing joints. For example, a tubular production string (also known as a production casing) typically consists of sections of steel pipe, which are threaded so that they can interlock together. In alternative aspects, the downhole conveyance 116 may be coiled tubing. Further, in some cases, a wireline or slickline conveyance (not shown) may be communicably coupled to the downhole fluid separation tool 116.

In some embodiments of the wellbore system 100, the wellbore 112 may be cased with one or more casings. As illustrated, the wellbore 112 includes a conductor casing 104, which extends from the terranean surface 102 shortly into the Earth. A portion of the wellbore 112 enclosed by the conductor casing 104 may be a large diameter borehole. Additionally, in some embodiments, the wellbore 112 may be offset from vertical (for example, a slant wellbore). Even further, in some embodiments, the wellbore 112 may be a stepped wellbore, such that a portion is drilled vertically downward and then curved to a substantially horizontal wellbore portion. Additional substantially vertical and horizontal wellbore portions may be added according to, for example, the type of terranean surface 102, the depth of one or more target subterranean formations, the depth of one or more productive subterranean formations, or other criteria.

Downhole of the conductor casing 104 may be the surface casing 106. The surface casing 106 may enclose a slightly smaller borehole and protect the wellbore 112 from intrusion of, for example, freshwater aquifers located near the terranean surface 102. The wellbore 112 may then extend vertically downward. This portion of the wellbore 112 may be enclosed by the intermediate casing 108. In some aspects, the location in the wellbore 112 at which the downhole fluid separation tool 116 is moved to may be an open hole portion (for example, with no casing present) of the wellbore 112 or a cased portion.

In the illustrated implementation of wellbore system 115, multiple perforations 115 are shown (for example, apertures explosively formed in a casing of the wellbore 112). Wellbore fluids, such as the mixed-phase fluid, may be released from the rock formation of the zone 114 and into an annulus 111 of the wellb ore 112. In some aspects, the release of the wellbore fluids into the wellbore 112 may be due to, for example, a pressure difference between the rock formation and the wellbore 112. In some aspects, hydraulic fractures (not shown) may be created in the rock formation through the perforations 115, thereby releasing the mixed-phase fluid from the rock formation of the subterranean zone 114 to the wellbore 112.

Figure 2:
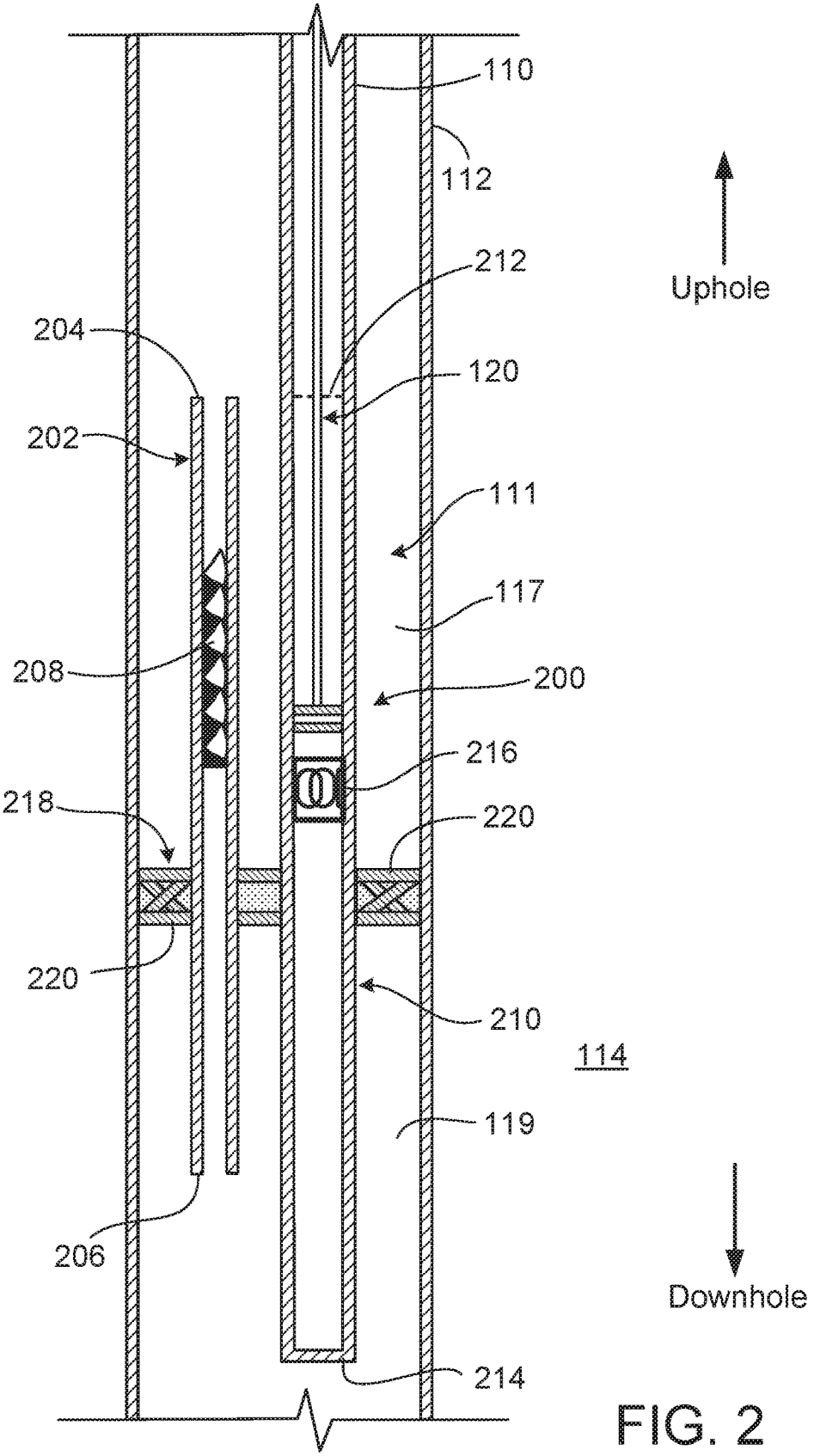
FIG. 2 is a schematic illustration of an example implementation of a downhole fluid separation tool.

FIG. 2 is a schematic illustration of an example implementation of a downhole fluid separation tool 200. In this figure, downhole fluid separation tool 200 is shown in the wellbore 112 and, generally, may be implemented as downhole fluid separation tool 116 shown in wellbore system 100. In this example implementation, the downhole fluid separation tool 200 includes, for example, a separation tubular 202, a production tubular 210, and a wellbore seal 218. As shown, the downhole fluid separation tool 200 is coupled (for example, threadingly or otherwise), to the production string (or production casing) 110 that extends from a terranean surface, through the wellbore 112. In this example, the production string 110 is coupled to the production tubular 210 of the downhole fluid separation tool 200.

As illustrated, the separation tubular 202 includes an uphole end 204 that is open to the annulus 111 and a downhole end 206 that is also open to the annulus 111. Mounted within a volume of the separation tubular 202 is a fluid separator 208. In this example, the fluid separator 208 comprises one or more baffles that are operable to separate a flow of gas and a flow of liquid from a mixed-phase fluid. Thus, in some examples, the separator 208 may comprise a two-stage separator in which a first stage of separation is through a diverting of fluids in two directions (for example, uphole and downhole) and a second stage of separation is, for instance, one or more baffles.

The production tubular 210, in this example, is coupled to the production string 110 at an open, uphole end 212. Although illustrated in this example as a dotted line at about a same or similar wellbore depth as the uphole end 204 of the separator tubular 202, the uphole end 212 may vary in location, for example, shallower or deeper (in other words, more uphole or more downhole) than that shown. In some aspects, as shown here, a length of the production tubular 210 is greater than a length of the separator tubular 202. In some cases, the length of the separator tubular 202 may vary, for example, based on well conditions, such as an amount of free gas, an amount of gas in solution (in the mixed-phase fluid), or other fluid properties of the mixed-phase fluid in the wellbore 112. In some examples, the length of the separator may affect a separation efficiency of the downhole fluid separation tool 116, for example, also based on actual fluid properties of the particular well.

As shown in FIG. 2, an artificial lift device 120 is positioned, at least in part, in the production tubular 210. In this example, the artificial lift device 120 comprises a sucker rod pump, with the sucker rod string and plunger/valve assembly shown schematically. In other implementations, the artificial lift device 120 may be a progressive cavity pump. In any event, the artificial lift device 120 is operable to circulate liquid (for example, a hydrocarbon liquid) from the production tubular 210 (including a sump area adjacent the closed end 214), up through the production string 110, and to the terranean surface 102.

In the example implementation of FIG. 2, the production tubular 210 includes an adjustable opening 216 positioned in a portion of the tubular 210. The adjustable opening 216, in this example, operates to selectively fluidly couple a volume of the production tubular 210 with the annulus 111 of the wellbore 112. In some aspects, the adjustable opening 216 comprises a sliding side door or sliding sleeve, which operates to create a fluid (for example, liquid) flow path between the annulus 111 and the production tubular 210. In some aspects, the sliding side door or sliding sleeve includes one or more ports that, when opened, create the flow path. The ports, in some examples, can be opened or closed by a sliding component controlled and operated by a wireline or slickline (not shown).

Wellbore seal 218, in this example, is positioned between the respective uphole ends 204 and 212 and the respective downhole ends 206 and 214. The wellbore seal 218 radially surrounds the separator tubular 202 and the production tubular 210 and, when actuated, may fluidly isolate an uphole portion 117 of the annulus 111 from a downhole portion 119 of the annulus 111. As further shown, in this implementation of the downhole fluid separation tool 200, the wellbore seal 218 is positioned downhole of the adjustable opening 216 of the production tubular 210. In some aspects, the wellbore seal 218 may comprise two or more production packers 220, with each production packer 220 positioned around one of the tubulars 202 or 210.

Figure 3:
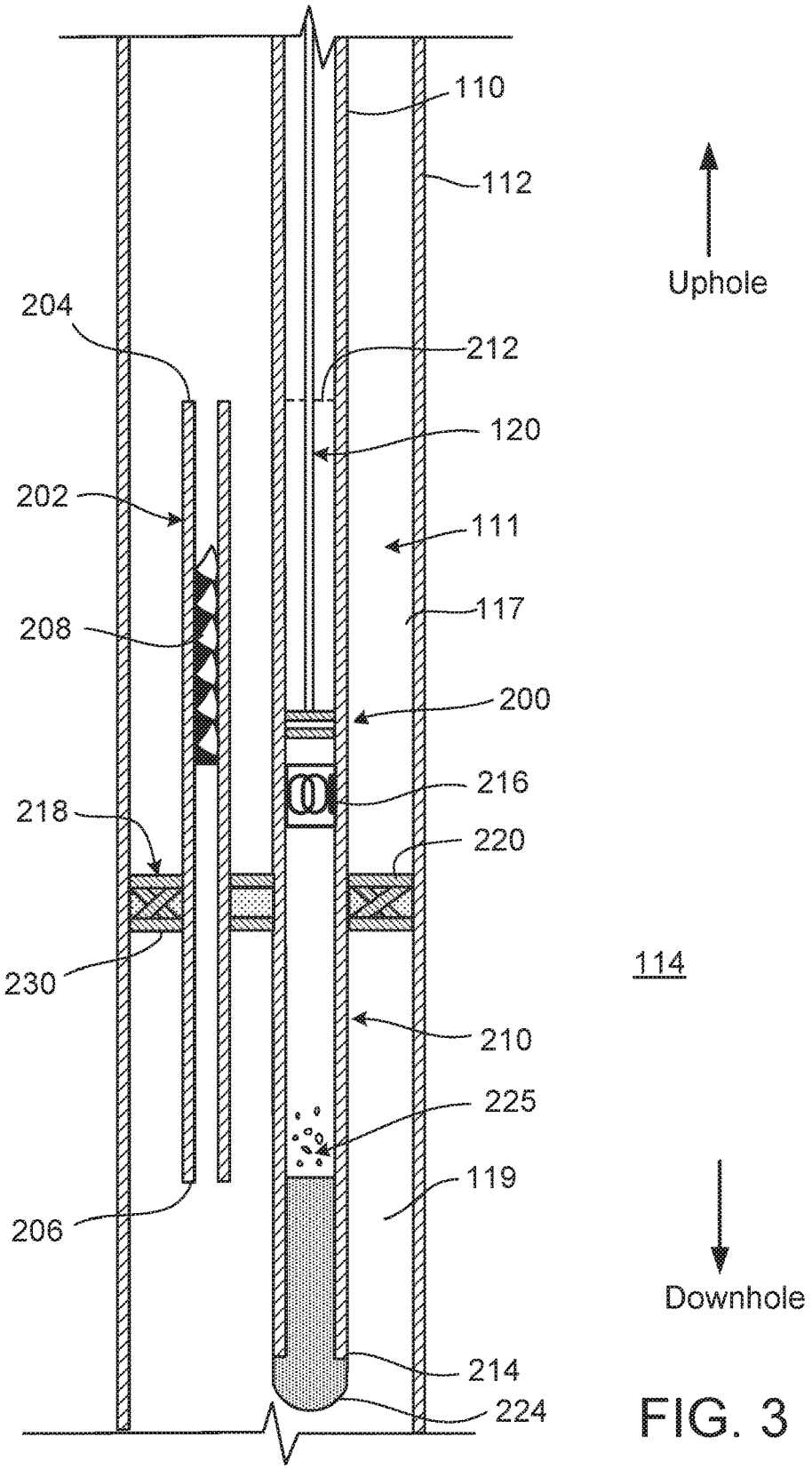
FIG. 3 is a schematic illustration of another example implementation of a downhole fluid separation tool.

Turning briefly to FIG. 3, this figure shows another implementation of the downhole fluid separation tool 200 including a particulate trap 224 mounted adjacent the downhole, closed end 214 of the production tubular 210. For example, as shown, the particular trap 224 may be mounted in a sump area (for example, at the closed, downhole end 214) of the production tubular 210. Generally, the particulate trap 224, which in some aspects may be a sand trap or sand filter, captures sand, fines, and other particulates 225 entrained within a flow of a liquid in the volume of the production tubular 210, thereby preventing (or helping to prevent) such particulates 225 from reaching the artificial lift device 120. In some aspects, by preventing (or helping to prevent) such particulates from reaching the artificial lift device 120, the operation of the device 120 may be improved.

Figure 4:
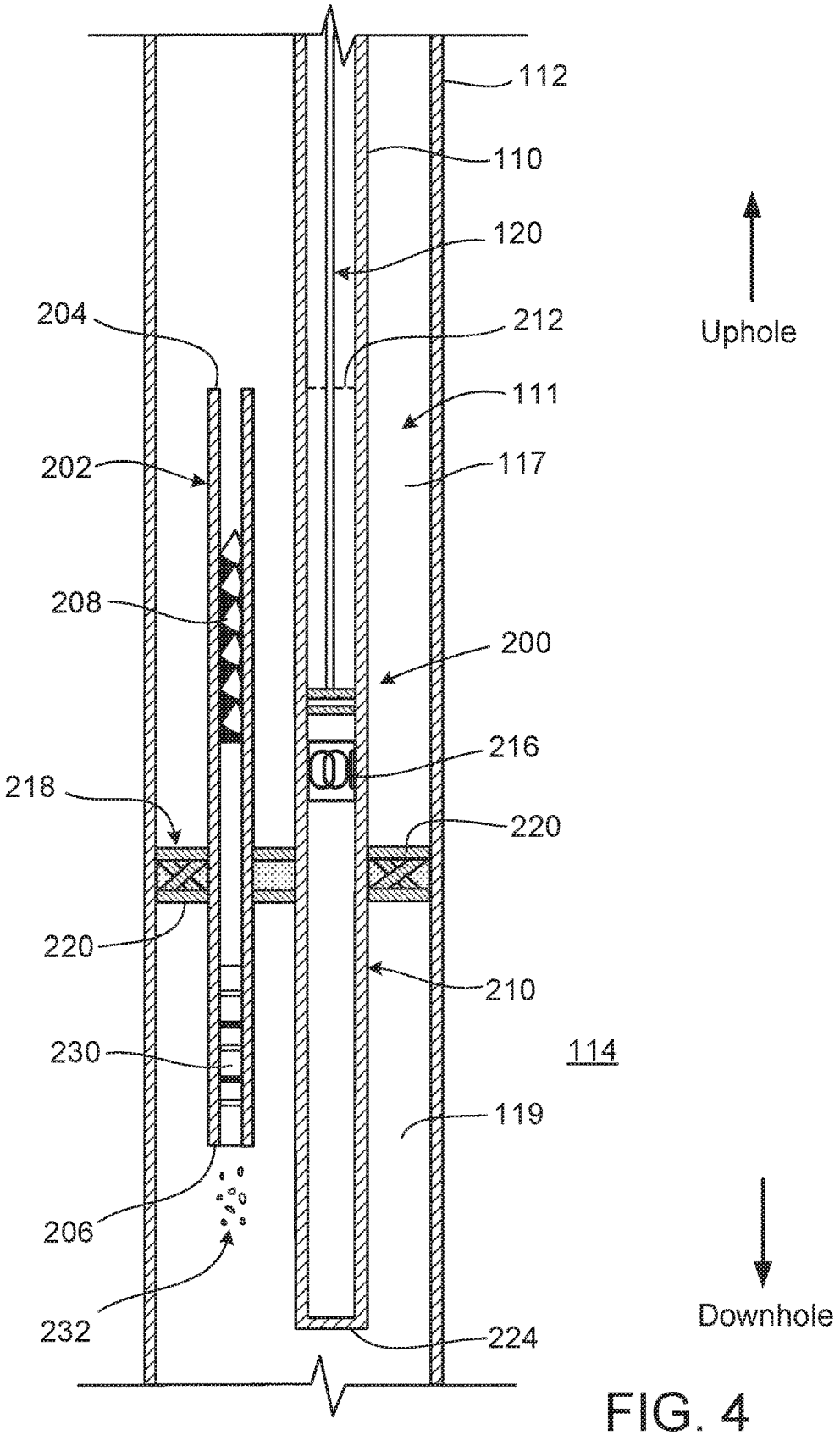
FIG. 4 is a schematic illustration of another example implementation of a downhole fluid separation tool.

Turning briefly to FIG. 4, this figure shows another implementation of the downhole fluid separation tool 200 including a particulate filter 230 mounted adjacent the downhole, open end 206 of the separation tubular 202. For example, as shown, the particular filter 224 may be mounted in the separation tubular 202 to prevent, or help prevent, sand, fines, and other particulates 232 that are entrained in the mixed-phase fluid from entering the open end 206. Thus, along with the particulate trap 224, the particulate filter 230 may prevent (or help prevent) such particulates 232 from reaching the artificial lift device 120. Further, by preventing (or helping prevent) particulates 232 from reaching the volume of the separation tubular 202 (for example, uphole of the wellbore seal 218), the separator 208 (for example, baffles) may operate more efficiently to separate the gas and liquid phases of the mixed-phase fluid. Thus, in some aspects, implementations of the downhole fluid separation tool 200 may include both the particulate trap 224 and the particulate filter 230.

Figure 5:
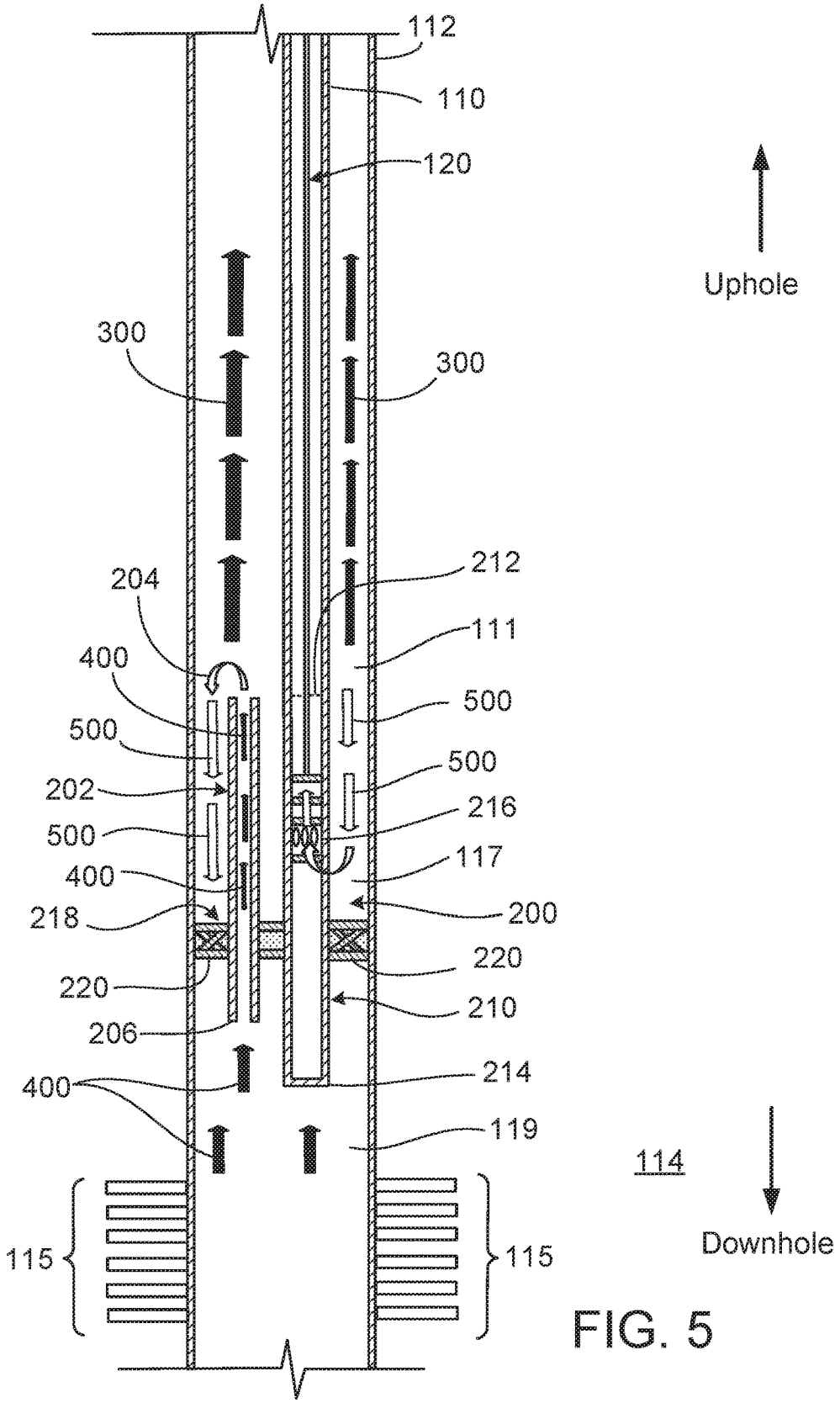
FIG. 5 is a schematic illustration showing an example operation of an example implementation of a downhole fluid separation tool.

FIG. 5 is a schematic illustration showing an example operation of the downhole fluid separation tool 200. Although FIG. 5 depicts the example operation of the downhole fluid separation tool 200 as illustrated, other embodiments of the downhole fluid separation tool 200 according to the present disclosure may also be used in this (and other) example operation. As illustrated, the downhole fluid separation tool 200 may be run into the wellbore 112 and positioned just uphole of one or more perforations 115 that are formed in the wellbore 112 (or casing in the wellbore 112) adjacent the subterranean zone 114. Once positioned, the wellbore seal 218 (for example, two or more production packers 220) may be actuated to contactingly engage the wellbore 112 and anchor the downhole fluid separation tool 200 at the particular location in the wellbore 112. The actuated wellbore seal 218 also fluidly isolates the uphole portion 117 of the annulus 111 from the downhole portion 119 of the annulus 111.

As shown, a mixed-phase fluid 400 flows, for example, from the subterranean zone 114, through the perforations 115, and into the annulus 111 (for example, the downhole portion 119). As shown, the wellbore seal 118 directs (substantially or all) the mixed-phase fluid 400 into the downhole, open end 206 of the separation tubular 202 and into the volume of the tubular 202. For instance, the mixed-phase fluid 400 is prevented from flowing from the downhole portion 119 of the annulus 111 to the uphole portion 117 of the annulus 111 due to the actuated wellbore seal 118 (and the closed downhole end 214 of the production tubular 210). In some aspects, such as when the separation tubular 202 includes the particulate filter 230, particulates entrained in the mixed-phase fluid 400 may be prevented (or substantially prevented) from entering the separation tubular 202.

Next, the mixed-phase fluid 400 enters the separation tubular 202, for example, due to a pressure difference that naturally circulates the fluid 400 into the tubular 202, a pressure difference generated by the artificial lift device 120 that circulates the fluid 400 into the tubular 202, or both. As the mixed-phase fluid 400 enters the separator 208, a gas phase 300 is separated from a liquid phase 500. In some aspects, the mixed-phase fluid 400 includes a hydrocarbon gas (separated as gas phase 300) and a hydrocarbon liquid (separated as liquid phase 500). In some aspects, the mixed-phase fluid 400 includes a hydrocarbon gas (separated as gas phase 300) and a non-hydrocarbon liquid, such as brine or freshwater (separated as liquid phase 500). In some aspects, the mixed-phase fluid 400 includes a hydrocarbon gas (separated as gas phase 300) and a mixture of hydrocarbon and non-hydrocarbon liquid (separated as liquid phase 500).

As shown in FIG. 5, in the example operation, the separated gas phase 300 may, once it exits the uphole, open end 204 of the separation tubular 202, migrate uphole in the wellbore 112 and eventually be produced at the terranean surface 102. Such migration may occur, for example, due to a pressure difference within the wellbore 112, thus naturally circulating the gas phase 300 uphole. The gas phase 300 also, for example, may be less dense than other fluids within the wellbore 112, thereby causing it to migrate uphole.

The separated liquid phase 500 may, once it exits the uphole, open end 204 of the separation tubular 202, fall downhole toward the wellbore seal 218. As a volume of the liquid phase 500 gathers and builds on the wellbore seal 218, a flow of the liquid phase 500 may enter the production tubular 210 through the adjustable opening 216 (for example, a sliding sleeve opened by a slickline intervention operation). The liquid phase 500 may flow into the production tubular 210 and gather, for example, in a sump area adjacent the downhole, closed end 214 of the production tubular 210. In some aspects, the particulate trap 224 may filter entrained particulates within the liquid phase 500 that is in the sump area.

Once the liquid phase 500 enters the production tubular 210, the artificial lift device 120 operates to circulate the liquid phase 500 through the production tubular 210, into the production casing 110, and to the terranean surface 102. Thus, both the gas phase 300 and liquid phase 500 may be separately produced (in fluidly isolated conduits within the wellbore 112) from the subterranean zone 114 to the terranean surface 102.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A downhole fluid separator, comprising:

a first tubular comprising a volume defined between an open, uphole end of the first tubular opposite an open, downhole end of the first tubular, the volume of the first tubular comprising a fluid pathway configured to receive a mixed-phase fluid from an annulus of a wellbore and provide separate flows of a gas and a liquid to the uphole end of the first tubular;

a second tubular comprising a volume configured to receive at least a portion of a downhole artificial lift device through an open, uphole end of the second tubular opposite a closed, downhole end of the second tubular, and an adjustable opening formed in a portion of the second tubular at a location between the uphole and downhole ends and configured to selectively receive the flow of the liquid into the volume of the second tubular;

an actuatable wellbore seal positioned around each of the first and second tubulars and between the first and second tubulars, downhole of the adjustable opening, and between the uphole ends and the downhole ends of the respective first and second tubulars; and a particulate trap positioned in the closed, downhole end of the second tubular that is downhole of the actuatable wellbore seal, and configured to trap particulates entrained in the liquid.

2. The downhole fluid separator of claim 1, wherein the second tubular comprises a length greater than a length of the first tubular.

3. The downhole fluid separator of claim 1, wherein the first tubular further comprises a plurality of baffles configured to separate the mixed-phase fluid into the separate flows of the gas and the liquid.

4. The downhole fluid separator of claim 1, wherein the actuatable wellbore seal comprises one or more packers configured to, when actuated, fluidly seal a portion of the annulus adjacent the respective downhole ends of the first and second tubulars from another portion of the annulus adjacent the respective uphole ends of the first and second tubulars.

5. The downhole fluid separator of claim 4, wherein the one or more packers comprise production packers.

6. The downhole fluid separator of claim 4, wherein the one or more packers comprise a first packer positioned around the first tubular and a second packer positioned around the second tubular.

7. The downhole fluid separator of claim 1, wherein the adjustable opening comprises a sliding side door formed in the portion of the second tubular, the sliding side door configured to selectively open in response to an intervention operation.

8. The downhole fluid separator of claim 1, wherein the downhole artificial lift device comprises a sucker rod pump.

9. The downhole fluid separator of claim 8, wherein a motor of the sucker rod pump is positioned uphole of the actuatable wellbore seal.

10. The downhole fluid separator of claim 1, further comprising a particulate screen positioned in the open, downhole end of the first tubular and configured to screen particulates from the mixed-phase fluid.

11. The downhole fluid separator of claim 1, wherein the mixed-phase fluid comprises at least one of a hydrocarbon liquid or a hydrocarbon gas.

12. A method for separating a mixed-phase fluid, comprising:

running a downhole tool into a wellbore, the downhole tool comprising:

a first tubular comprising a volume defined between an open, uphole end of the first tubular opposite an open, downhole end of the first tubular, a second tubular comprising a volume that includes at least a portion of a downhole artificial lift device and is defined between an open, uphole end of the second tubular opposite a closed, downhole end of the second tubular, and a wellbore seal radially positioned around each of the first and second tubulars and between the first and second tubulars, and axially positioned between the uphole ends and the downhole ends of the respective first and second tubulars;

receiving a flow of a mixed-phase fluid into the open, downhole end of the first tubular;

separating, in the volume of the first tubular, the mixed-phase fluid into a flow of a gas and a flow of a liquid;

directing the flows of the gas and the liquid out of the open, uphole end of the first tubular;

selectively receiving the flow of the liquid into the volume of the second tubular through an adjustable opening positioned in the second tubular;

filtering particulates entrained in the liquid with a particulate trap positioned in the closed, downhole end of the second tubular that is downhole of the wellbore seal; and removing, with the downhole artificial lift device, the flow of the liquid from the volume of the second tubular into a production tubing.

13. The method of claim 12, wherein the second tubular comprises a length greater than a length of the first tubular.

14. The method of claim 12, wherein separating the mixed-phase fluid into the flow of the gas and the flow of the liquid comprises:

directing the mixed-phase fluid through a plurality of baffles positioned in the volume of the first tubular; and separating, with the plurality of baffles, the mixed-phase fluid into the flows of the gas and the liquid.

15. The method of claim 12, further comprising, prior to receiving the flow of the mixed-phase fluid into the open, downhole end of the first tubular, actuating the wellbore seal to fluidly seal a portion of an annulus of the wellbore adjacent the respective downhole ends of the first and second tubulars from another portion of the annulus adjacent the respective uphole ends of the first and second tubulars.

16. The method of claim 15, wherein the wellbore seal comprises a first packer positioned around the first tubular and a second packer positioned around the second tubular.

17. The method of claim 12, wherein the adjustable opening comprises a sliding side door formed in the portion of the second tubular, the method further comprising performing an intervention operation to open the sliding side door.

18. The method of claim 12, wherein the downhole artificial lift device comprises a sucker rod pump.

19. The method of claim 18, further comprising operating the sucker rod pump with a motor positioned uphole of the wellbore seal.

20. The method of claim 12, further comprising filtering particulates from the mixed-phase fluid with a particulate filter positioned in the open, downhole end of the first tubular.

21. The method of claim 12, further comprising:

receiving the flow of the liquid through the production tubing and at a terranean surface; and receiving the flow of the gas from the open, uphole end of the first tubular, into and through the wellbore, and at the terranean surface.

22. The method of claim 12, wherein the mixed-phase fluid comprises at least one of a hydrocarbon liquid or a hydrocarbon gas.

* * * * *